United States Patent [19]

Lovejoy et al.

[11] 4,038,169

[45] July 26, 1977

[54] INDEXING SYSTEM

[75] Inventors: Curtis N. Lovejoy, Walpole; Leo N. Kosowsky, Sharon; Paul C. Holte, Canton, all of Mass.

[73] Assignee: National Plastics & Plating Supply, Terryville, Conn.

[21] Appl. No.: 550,348

[22] Filed: Feb. 18, 1975

[51] Int. Cl.[2] ..... C25D 5/02; C25D 17/00

[52] U.S. Cl. ..... 204/202; 204/15; 204/28; 204/206; 204/224 R

[58] Field of Search ..... 204/224 R, 206, 15, 204/28, 202–204

[56] References Cited

U.S. PATENT DOCUMENTS

| | | | |
|---|---|---|---|
| 1,417,464 | 5/1922 | Edison | 204/13 |
| 2,335,776 | 11/1943 | Macan | 204/216 |
| 2,445,675 | 7/1948 | Lang | 204/209 |
| 3,669,866 | 6/1972 | Girard et al. | 204/28 |
| 3,788,963 | 1/1974 | Kosowsky et al. | 204/206 |
| 3,860,499 | 1/1975 | Graham et al. | 204/15 |
| 3,865,698 | 2/1975 | Kosowsky et al. | 204/15 |
| 3,977,957 | 8/1976 | Kosowsky et al. | 204/224 R |

*Primary Examiner*—F.C. Edmundson

*Attorney, Agent, or Firm*—Robert A. Cesari; John F. McKenna; Andrew F. Kehoe

[57] ABSTRACT

Apparatus for selective electroplating of discreet areas of strips intermittently advanced through said apparatus. A particularly important aspect of the apparatus is the means whereby the strip is advanced intermittently but is, at all times, held under tension by a dual-clutch arrangement comprising two indexing wheels, a drag clutch positioned to control tension on a first wheel at one side of the electroplating bath, and another indexing wheel intermittently operated to advance the strip on intermittent engagement by controlled by a second clutch mechanism.

3 Claims, 5 Drawing Figures

INDEXING SYSTEM

BACKGROUND OF THE INVENTION

This invention relates to an apparatus and a process for electroplating a plurality of pre-selected isolated areas on incremental segments of an elongate metal strip while maintaining the rest of the strip out of contact with the electroplating bath. More particularly, the invention relates to a means for providing controlled advancement of the strip as each segment is positioned for exposure to the electroplating bath.

In many electroplating operations, e.g. operations wherein microcircuits are electroplated with gold, there is a need to minimize the amount of expensive metal utilized by closely restricting its deposition to only those surface areas where its presence is essential. It is desirable, however, that such selective deposition of the metal achieved without resorting to procedures which greatly restrict the production rate of an electroplating facility or to procedures which greatly increase the handling costs of the items being electroplated.

It has been known to use organic coatings to mask those areas of metallic substrates on which electroplating is not required and thereby avoid those areas being electroplated. After electroplating of such partially masked items is finished, the masking material is removed, leaving discrete electroplated zones. Such a process requires expensive coating and stripping steps. These steps add to the cost of the electroplating operation and also increase the probability that some of the costly work product will have to be scrapped because of damage incurred during the manufacturing operations.

The most suitable apparatus of the solution of such problems are disclosed in the commonly-owned and co-pending United States Patents to Kosowsky et al. Such apparatus uses seal means to selectively isolate the surface of sheet which are to be exposed to contact with the electroplating fluid. The latter of these applications describes means to continuously electroplate an elongate suitable for use on very large runs of a strip with a particular metallic pattern; however, it has been found to be inconvenient to modify the sealing parts of such apparatus to accommodate a series of smaller runs of strips of different configurations. Another drawback to this continuous plating-type of apparatus is that it requires a relatively large amount of space because the various processing steps must be carried out as the strip moves through processing stations elongated to compensate for the movement of the strip. Therefore, it is desirable, for smaller orders, to construct apparatus for the intermittent electroplating of elongate strips which will allow the strips to be advanced step-by-step. Consequently, the strips must be stationary during the electroplating procedure.

One means of achieving such step-by-step advancement is described in U.S. Pat. No. 3,788,963, and commonly-owned and co-pending U.S. application Ser. No. 400,153 filed on Sept. 23, 1973 by Kosowsky et al. In this patent and application, a novel advancement is achieved using a sensing means and a vibration-dampening vise to establish, respectively, (1) that the strip was positioned properly on each forward movement thereof and (2) vibrations from winding means were not transmitted back to the electroplating bath. This system performed very well; nevertheless, there was sufficient machine downtime caused by the occasional movement of the strip out of register that it was thought desirable to provide an apparatus that would have an improved advancement means, one that would have the advantage of avoiding misplaced plating of valuable metals, an attribute of the earlier apparatus, but also machine that would substantially eliminate the need for periodic shut-downs necessary for realigning the tape.

SUMMARY OF THE INVENTION

Therefore, it is an object of the instant invention to provide compact apparatus which can quickly and conveniently effect the uniform electroplating of a large number of preselected, discrete, surface zones of a strip as it is intermittently advanced along a processing line.

A further object of the invention is to provide an apparatus as described above that has a constant positive mechanical interlock between an advancement mechanism and the strip being processed, said interlock forming means to hold said strip fast against spurious movement throughout said processing movement.

Another object of the invention is to provide electroplating apparatus for intermittent electroplating of a strip which comprises means to automatically confirm the satisfactory advancement, and positioning, of said strip on each incremental movement thereof.

Other objects of the invention will be obvious to those skilled in the art on reading the instant application.

The above objects have been substantially achieved by providing a novel electroplating apparatus comprising an advancement means having a strip-engaging cylinder carrying upon it a series of radially-projecting pins so spaced that they engage apertures in the strip of material being electroplated. This strip-engaging cylinder is caused to turn after each plating cycle and pull a segment of the strip forward through a plating station. The pins keep the strip in proper register at all times. Moreoever, a tension-producing means, preferably by a drag clutch, is used to keep a minimum tension on the strip and prevent spurious vibration transverse to the general direction of the strip through the apparatus.

The invention provides replaceable indexing and tension wheels, i.e. wheels having whatever pin-spacing and diameter are required for electroplating a particular strip of material. It should be emphasized that in the most favorable embodiments of the invention pins are aligned along both the top and bottom circumference of the wheel, thereby tending to avoid any non-linear stress on the strip being processed.

Illustrative Example of the Invention

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

Figure 1:
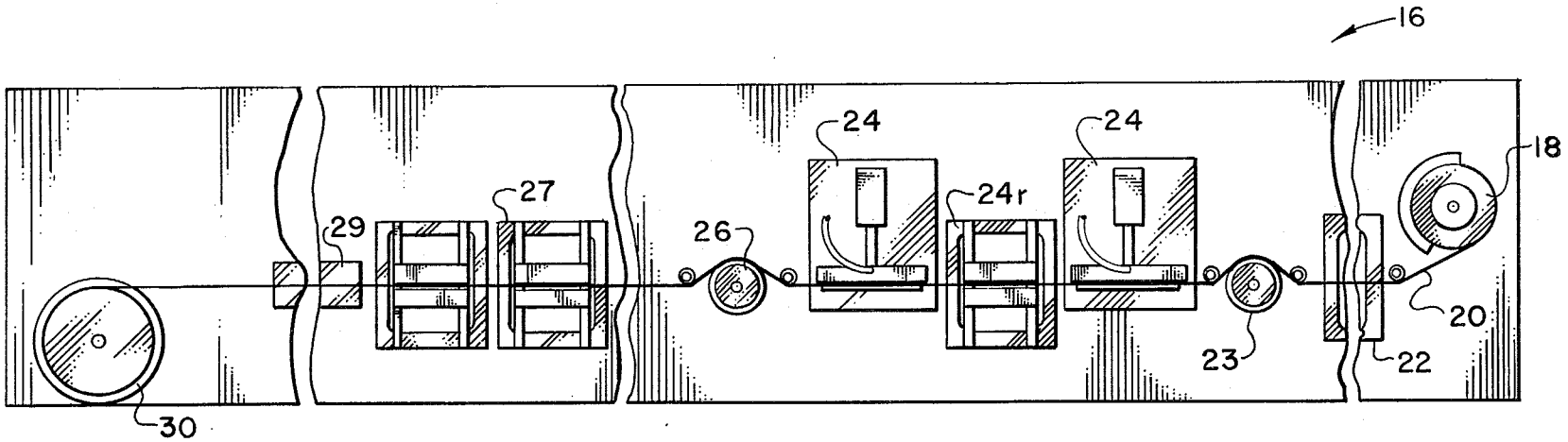
FIG. 1 is a schematic elevation of a production line whereon selected portions of a strip of metal are electroplated.

Referring to FIG. 1, it is seen that electroplating production line 16 comprises a supply roll 18 of perforated metal strip 20 which is to be electroplated. The strip is fed through a number of cleaning baths illustrated schematically at 22 but not shown in any detail because such cleaning steps are old in the art and do not form any part of the present invention. After passing through the cleaning baths, the metal strip engages a drag-clutch controlled tension wheel 23, is electroplated in at least one of electroplating stations 24, then engaged by an intermittently actuated positive advance wheel 26 and urged forward through post-electroplating treatment baths 27 and oven 29. Thence strip 20 passes into a winding apparatus 30.

Figure 5:
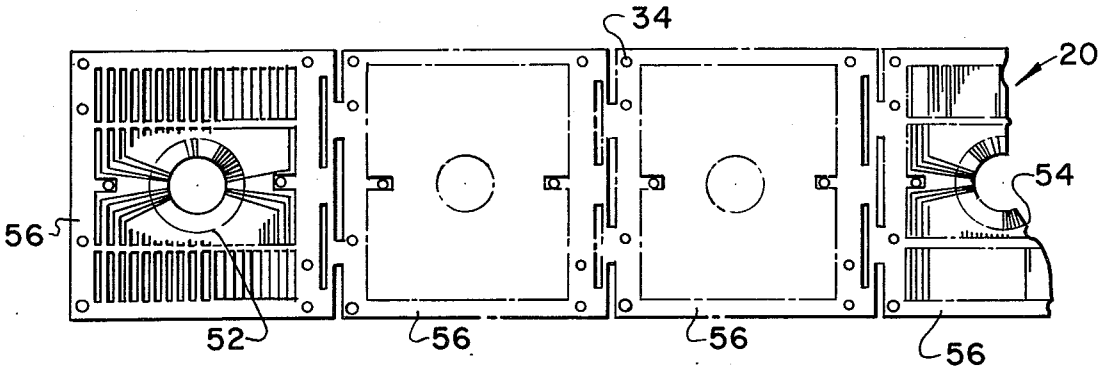
FIG. 5 is a plan view, of a segment of a typical strip (enlarged by about 2 in linear dimension to facilitate drawings) of the type often processed on the apparatus of the invention.

FIG. 5 shows a portion of a continuous metal strip 20 which is foraminous enough to allow the passage of electroplating fluid through leadframes 56 and on which it is desirable to electroplate a metal, say gold only on the surface 52 indicated within the dotted circles 54 on each segment of the strip.

Applicant will not describe herein the structure of the electroplating stations. These are now well known in the art as is evidenced by U.S. Pat. No. 3,788,963. Similarly the pneumatic and electrical systems by which the various steps of electroplating and advancement are performed in proper sequence are well within the ken of all those skilled in the mechanical arts and are similar to those described herein only as they may be thought necessary to define the operation of the novel strip-advancement and strip-tensioning improvements to which this invention is directed.

Each of the wheels 23 and 26 are similar and each have two circumferential rows 31 of regularly-occuring projections 32 thereon which are adapted to engage apertures 34 on strip 20. Adjustable guide rollers 36 are mounted adjacent wheels 23 and 26 and form means to reduce any play in the leadframe strip 20, e.g. as it is carried past the indexing wheel 26.

Rotation of wheel 23 is through a drag clutch 38 which forms means to hold the wheel under constant tension. Indexing wheel 26 is operated through a continuously-operated clutch mechanism 40. Clutch 40 is engaged to turn the indexing wheel only when it receives a signal from the position of the plating fixture or some other plating-cycle-generated parameter.

Figure 2:
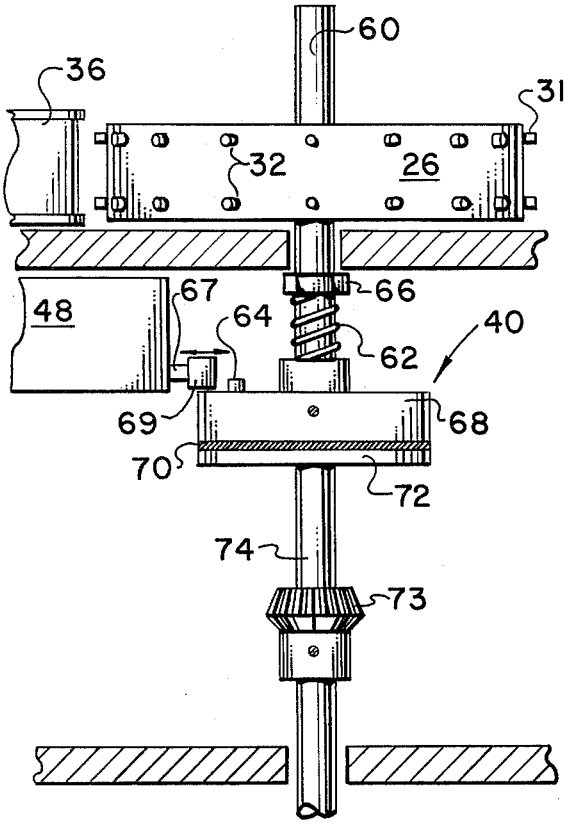
FIG. 2 is an elevation of an intermittently-actuated advance mechanism operated according to the invention.

Referring to FIG. 2, it is seen that wheel 26 is operably keyed to an upper shaft 60 carrying clutch mechanism 40. On shaft 60, below wheel 26 is keyed a tension spring 62 and an adjustment nut 66. A threaded portion 66 of shaft 60 provides means to adjust the tension on spring 62 by means of turning nut 66. A continuously-operating clutch mechanism 40, comprises an upper clutch member 68 which is also keyed to shaft 60 and against which spring 62 bears. On member 68, is a locking pin 64 which is adapted rotate with member 68 when locking air cylinder arm 69 is in retracted position as shown in FIG. 2.

Just below member 68 is a clutch facing 70 forming the interface between intermittently driven member 68 and a continuously driven lower clutch member 72. Gears and bearings 73 form part of a conventional means to drive clutch member 72. Clutch facing 70 and driven member 68 are, of course, mounted on an independently and continuously operated lower shaft 74.

Figure 3:
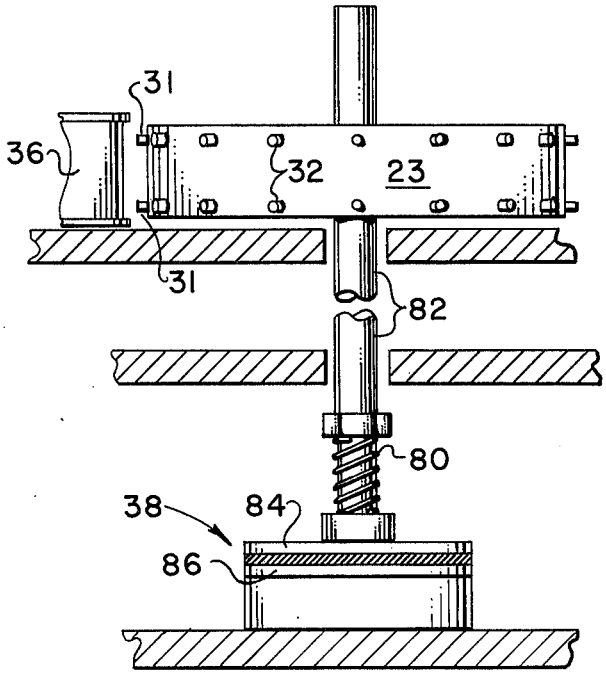
FIG. 3 is an elevation of a tension-maintaining device operated according to the invention.

FIG. 3 illustrates a constant tension clutch 38 used to regulate the tension of wheel 23. Clutch 38 is constantly rotated against a tension achieved by use of a spring 80. Wheel 23 which is mounted on an upper shaft 82 cannot turn freely; it turns only against the preselected tension between upper clutch member 84 and clutch friction disk 86. This is an important feature of the invention because it dampens the sudden starts and stops which are inherent in the prime strip-moving means and effectively prevents such stops and starts from imparting undesirable movement to the strip during processing.

Figure 4:
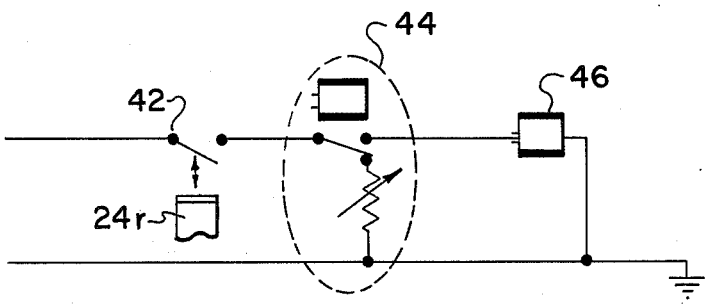
FIG. 4 is a schematic diagram indicative of the automated control of the advancement means of FIG. 2.

Operation is illustrated by starting with a situation wherein a strip 50 has been threaded through the line 16. So threaded, it will be engaged on projections 32 on each of wheels 23 and 26. We take the case, as a starting point, wherein a desired plating cycle has just been completed:

The plating stations 24 open and the retracting portion 24r of plating statin 24 trips a microswitch 42 as seen in the schematic circuit of FIG. 4. Microswitch 42, closes a circuit which includes time relay 44 which, in turn, actuates solenoid 46. Solenoid 46 operates a pneumatic valve which admits air to withdraw arm 69 extending from of air cylinder 48. Withdrawal of the air cylinder 48 is opposed by a spring lock means 57 schematically shown on FIG. 2. The air remains time sufficient effective for the arm 69 to become disengaged from a pin 64 projecting from the clutch member 68 and start movement. The movement is a consequence of the frictional seizure of clutch facing 70 and member 68 made possible by the disengagement of arm 69 and pin 64. Air cylinder 48 will keep arm 69 in the withdrawn position only for a relatively short time delay period, i.e. the period required for wheel 26 to start movement and pin 64 to clear arm 69. Return of arm 69 then occurs and, once again, it is positioned to engage pin 64 and become effective to stop member 68 after precisely one rotation of the wheel.

The above-discussed procedure assures exactly one full 360° turn of wheel 26 during each advancement of the strip to be electroplated.

It is to be understood that the following claims are intended to cover all of the generic and specific features of the invention herein described and all statements of the scope of the invention which might be said to fall therebetween.

What is claimed is:

1. In apparatus for electroplating pre-selected portions of a continuous metallic strip and of the type comprising means to intermittently advance said strip a precise distance through an electroplating station between electroplating sequential portions thereof, the improvement wherein said means to achieve said intermittent advance comprise A. an indexing wheel carrying a plurality of projections thereon adapted to engage a mating series of holes in said strip to be electroplated, means for intermittently driving said wheel comprising 1. a continuously driven friction clutch means 2. means to engage said driven clutch with said indexing wheel at the end of each electroplating cycle, 3. means to disengage said clutch after a single predetermined distance of travel of said indexing wheel and B. a constant tension wheel carrying a plurality of projections also adapted to engage a mating series of holes in said strip, and a constant-tension drag clutch means adapted to maintain a predetermined constant tension on said constant-tension wheel during the advancement thereof, C. and wherein said indexing wheel and said tension wheel are positioned on opposite sides of said electroplating station.

2. Apparatus as defined in claim 1 wherein said means to engage said clutch comprises 1. means to lock said drive wheel against motion
2. means to unlock said wheel to allow movement at the conclusion of each electroplating cycle
3. means to reset said lock means, thereby forming means to stop said wheel precisely at the end of a predetermined advance of said strip.

3. Apparatus as defined in claim 1 wherein each of said indexing wheel and said constant tension wheel comprise a plurality of rows of projections thereon, one row adapted to engage said strip proximate each side of said strip.

* * * * *

UNITED STATES PATENT AND TRADEMARK OFFICE

CERTIFICATE OF CORRECTION

PATENT NO. : 4,038,169

DATED : July 26, 1977

INVENTOR(S) : Curtis N. Lovejoy, Leo N. Kosowsky, Paul C. Holte

It is certified that error appears in the above-identified patent and that said Letters Patent are hereby corrected as shown below:

Column 3, line 61: delete "66"

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*